United States Patent [19]

Galperin et al.

[11] 4,250,932

[45] Feb. 17, 1981

[54] METHOD OF AND AN APPARATUS FOR SUPPLYING WEFT THREAD CARRIERS IN TRAVELLING-WAVE LOOMS

[76] Inventors: Alexandr L. Galperin, ulitsa Moldaqulovoi, 10, korpus 3, kv. 166; Eduard A. Onikov, ulitsa Panferova, 5, korpus 2, kv. 106, both of Moscow; Alexandr A. Zabotin, Belyaevo-Bogorodskoe, kvartal 45, korpus 26, kv. 85, Moscoa; Evgeny D. Loschilin, Domodedovo, ulitsa 8 Marta, Moscovskaya oblast, all of U.S.S.R.

[21] Appl. No.: 21,590

[22] Filed: Mar. 19, 1979

Related U.S. Application Data

[63] Continuation-in-part of Ser. No. 725,439, Sep. 22, 1976.

[51] Int. Cl.[3] ..... D03D 47/26

[52] U.S. Cl. ..... 139/436

[58] Field of Search ..... 139/224 R, 224 A, 436

[56] References Cited

U.S. PATENT DOCUMENTS

| | | | |
|---|---|---|---|
| 3,732,896 | 5/1973 | Jekl et al. | 139/436 |
| 3,835,893 | 9/1974 | Galperin et al. | 139/436 |
| 4,158,373 | 6/1979 | Onikov et al. | 139/436 |

*Primary Examiner*—Henry Jaudon

*Attorney, Agent, or Firm*—Steinberg & Raskin

[57] ABSTRACT

The present invention relates to methods of and apparatus for supplying weft thread carriers. In this method a thread is wound in the form of coils onto a spool of a carrier whereupon the carriers along with the thread are admitted into a weaving zone whereby an elongated section of the thread is formed to be sequentially separated from the coils, with the elongated section being thereafter pulled in a direction opposite to that of feed and, while being pulled the elongated section is arranged on a straight line connecting a thread guide and a braking point which, to compensate for the length of the pulled portion of the straight section, is moved away from the thread guide by a distance equal to this length.

In an apparatus for practicing this method a device for compensating for the portion of the elongated section comprises a bell crank installed on a disk on one arm of which bell crank there are located braking means and a stationary profiled cam cooperating with a free arm of this bell crank for the braking means to be moved away from the thread guide.

6 Claims, 6 Drawing Figures

METHOD OF AND AN APPARATUS FOR SUPPLYING WEFT THREAD CARRIERS IN TRAVELLING-WAVE LOOMS

CROSS-REFERENCE TO RELATED APPLICATIONS

This application is a continuation-in-part of application Ser. No. 725,439 filed Sept. 22, 1976.

BACKGROUND OF THE INVENTION

The present invention relates to travelling-wave looms and, more particularly, it relates to methods of and apparatus for supplying weft thread carriers (shuttles) used thereon.

At present, there are known methods of supplying weft thread carriers wherein a weft thread is fed in one direction from a bobbin for winding in the form of coils by a thread guide onto a spool of a carrier, with a free end of the weft thread gripped preliminarily. In a space between the thread guide and the bobbin the thread is braked. Subsequently, after the winding is completed, each carrier is admitted into a weaving zone, with an elongated section of the weft thread formed between this carrier and the thread guide, after which the coils of the weft thread are separated from the elongated section at the edge of the looming-up zone and a portion of the elongated section is sequentially pulled through a grip and the thread guide in a direction opposite to that of the feed for the elongated section to be compensated for, the pulling of the portion of the elongated section in the opposite direction being achieved by pulling in a direction normal to the direction of advance of the thread and by forming a loop intermediate of the braking point and the thread guide.

A known apparatus for practicing this known method comprises grips for the end of the weft thread arranged on a rotatable horizontal disk as well as thread guides installed on the disk so as to be rotatable around their own axes which extend parallel to the axis of rotation of the disk. The thread guides wind the thread nipped by the grip and unwound from a bobbin, in the form of coils onto the spools of carriers admitted successively by a conveyer into a weaving zone thereby forming a straight elongated section of the thread. Additionally, the apparatus includes a device for braking the thread unwound from the bobbin, a device for separating the elongated section from the coils and a device for compensating for a portion of the straight section by pulling that portion through one of the grips and the thread guide in a direction opposite to that of feed. The disk of the apparatus carries bell cranks entrailed by the thread for said loop to be formed which execute oscillatory motion in the horizontal plane.

Due to availability of the thread loop the thread is subjected to an additional mechanical action of the bell crank which, in turn, causes fraying and eventual breaking of the thread.

Besides, the location of the bell crank on the disk encumbers the zone thereby rendering the servicing of the apparatus inconvenient. If the weft thread breaks, the time required to repair the break is increased due to the fact that the weaving zone is encumbered and also due to the elimination of the break.

SUMMARY OF THE INVENTION

It is an object of the present invention to provide a method of and an apparatus for supplying weft thread carriers wherein the device for compensating for the portion of the elongated section is constructed so as to reduce the additional mechanical effect on the thread.

The principal object of the invention is to provide a method and an apparatus for realizing this method which will clear out the weaving zone.

It is another object of the invention to provide a method and an apparatus for realizing this method which will increase the loom productivity.

One more object of the invention is to provide an apparatus of such a structure which will make the servicing thereof less laborious.

These objects are attained by providing a method of supplying weft thread carriers in travelling-wave looms including the steps of feeding a weft thread from a bobbin and winding the same in the form of coils by a thread guide onto a spool of a carrier shuttle, with a free end of the weft thread gripped preliminarily, while in a space between the thread guide and the bobbin the thread is braked. After the winding is completed, each carrier is admitted into a weaving zone, with an elongated section of the weft thread being formed between each respective wound carrier and the thread guide, after which the coils of the weft thread are separated from the elongated section at the edge of the looming-up zone and thereafter, a portion of the elongated section is pulled through a grip and the thread guide in a direction opposite to that of feed to compensate for the elongated section. In accordance with the invention, the elongated section, while being pulled through the grip and the thread guide in a direction opposite to the direction of feed, extends along a straight line connecting the thread guide and a braking point which, in the course of compensation, is moved away from the thread guide by a distance equal to the length of the pulled portion of the elongated section.

The preferred apparatus for effecting the method of this invention comprises grips for the end of the weft thread arranged on a rotatable horizontal disk, thread guides, installed so as to be free to turn around their own axes extending parallel to the axis of rotation of the disk, for winding the thread, nipped by the grip and unwound from the bobbin, in the form of coils onto the spools of the carriers admitted in succession into the weaving zone by a conveyor whereupon the elongated thread section is formed, a device for braking the thread unwound from the bobbin, a device for separating the elongated section from the coils, and a device for compensating for the portion of the elongated section when this portion is pulled through one of the grips and the thread guide in a direction opposite to that of feed. In accordance with the invention, the device adapted to compensate for the portion of the elongated section includes a bell crank or level installed on the disk one arm of which carries said braking device, while a stationary profiled cam is situated relative to the bell crank so that at the moment of separation of the straight section a free arm of this bell crank comes in contact with the lowest part of the cam profile which subsequently travels to the upper part of the profile whereby said braking device is moved away from the thread guide by a distance equal to the length of the dragged portion of the straight section.

Inasmuch as the pulled portion of the straight section is placed on the straight line connecting the thread guide and the braking point, any curving of the thread is avoided, thereby additionally avoiding contact thereof with the additional devices, whereby the fraying and the breaking of the thread are precluded. What is more, the vertical displacement of the bell crank, that is the displacement in the direction of advance of the pulled portion of the elongated section clears out the weaving zone, as a result of which the time spent on elimination of any break is reduced.

Taken together all said advantages increase the loom productivity and make the servicing thereof less laborious.

To simplify the structure of the apparatus and to create the most favorable servicing and threading conditions, in accordance with another embodiment of the invention, the devices adapted to compensate for the portion of the elongated section include an additional disk placed above the main disk, outfitted at the periphery with said braking device and installed relative to the main disk so as to be able to rotate in step therewith, both disks being mutually arranged in such a manner that after the separation of the elongated section during their synchronous rotation through some angle said braking device is disposed at a distance from the thread guide sufficient for compensation of the pulled portion of the elongated section, with the axis of rotation of the additional disk being inclined at an angle to the axis of rotation of the main disk in a direction diametrically opposite to the position of the thread guide at the moment when the winding of the weft thread onto the spool of the carrier is initiated, the angle of inclination being chosen in accordance with the required length of the pulled portion of the elongated section for which compensation is made.

To make the apparatus more compact and to reduce the mass of the additional disk, in accordance with the invention, the axis of rotation of the additional disk may be parallel to and displaced from the axis of rotation of the main disk in a direction diametrically opposite to the position of the thread guide at the moment the winding of the weft thread onto the spool of the carrier is initiated, the disks having different diameters and the amounts of the displacement of the axles and the difference between the diameters of the disks being chosen in accordance with the required length of the pulled portion of the elongated section for which compensation is made.

DESCRIPTION OF THE DRAWINGS

Given below is a detailed description of the present invention with reference to the accompanying drawings, wherein.

DESCRIPTION OF THE PREFERRED EMBODIMENTS

Figure 1:
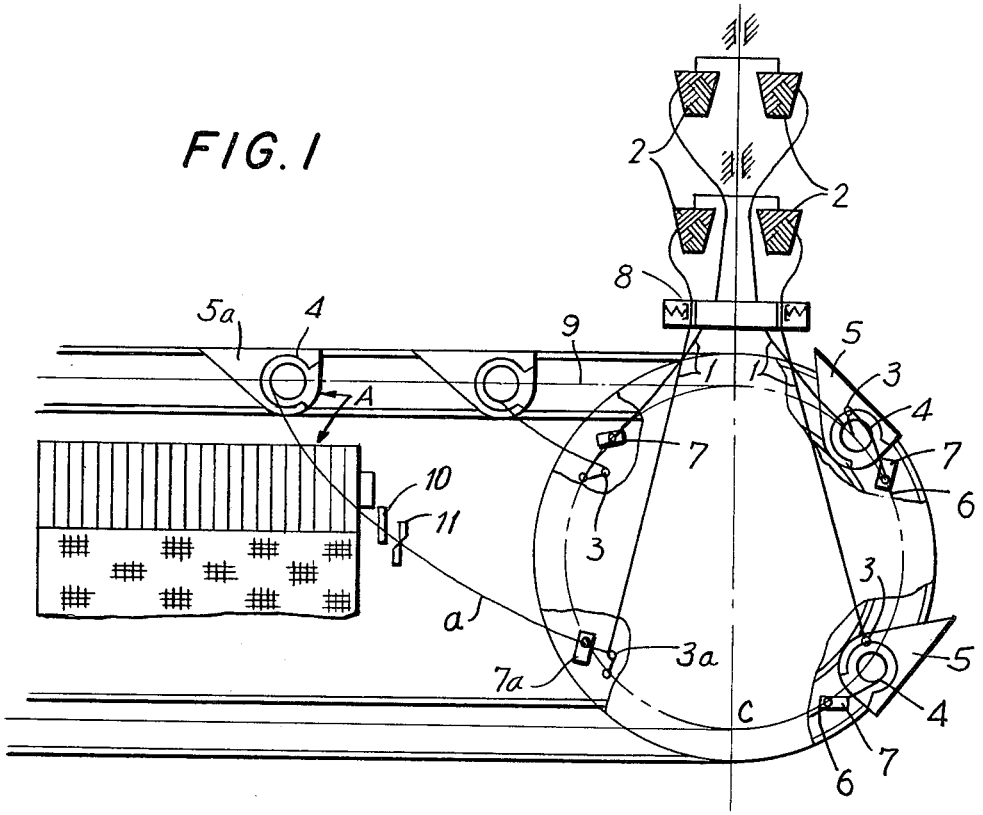
FIG. 1 is a schematic top view of an apparatus according to the present invention for practicing the proposed method of threading weft thread carriers.

Essentially the proposed method comprises feeding a weft thread 1 (FIG. 1) from a bobbin 2 for winding in the form of coils by a thread guide 3 onto a spool 4 of a carrier 5. Preliminarily a free end 6 of the weft thread is nipped by a grip 7. A known structure of the above type is illustrated in U.S. Pat. No. 3,835,893. In the space between the thread guide 3 and the bobbin 2 the thread 1 is braked by a braking means 8. After the winding is completed, the carrier 5 is admitted by a conveyer 9 into a weaving zone. At this time, a substantially straight section, designated "a" in FIG. 1 of weft thread 1 is formed between carrier 5 and the wound thread guide 3. After the carrier has entered the looming-up weaving zone, designated "A", and the elongated substantially straight section has been engaged by a grip 10 located at the edge of the weaving zone, the coils of the weft thread wound on the spool 4 of the carrier 5 are cut from the section "a" by a knife 11 also disposed at the edge of the weaving zone. Following this cutting, a portion of the section "a" is engaged and pulled by the grip 7 and the thread guide 3 in a direction opposite to the direction of advance of the weft thread during winding onto the spool. The entire portion of the section "a" to be pulled extends on a straight line connecting the thread guide 3 and a braking means 8. The braking means 8 then travels away from the thread guide 3 along with the portion of the straight thread portion "a".

Thus, referring to FIG. 1 a carrier 5*a* is shown which has entered into the looming-up or weaving zone "A" with an elongated, substantially straight length of weft thread "a" being engaged by grip 10. At this time, the knife 11 cuts the straight thread portion "a" and the grip 7*a* which engages the cut portion of section "a" begins to pull this section in a direction opposite to the direction of advance of the weft thread during its winding onto the spool. At this time, the braking means 8 which grips the weft thread between the bobbin 2 and the thread guide 3 begins to travel away from the thread guide 3 to compensate for the length of the straight thread portion "a" by pulling the same through the grip 7*a*.

Figure 6:
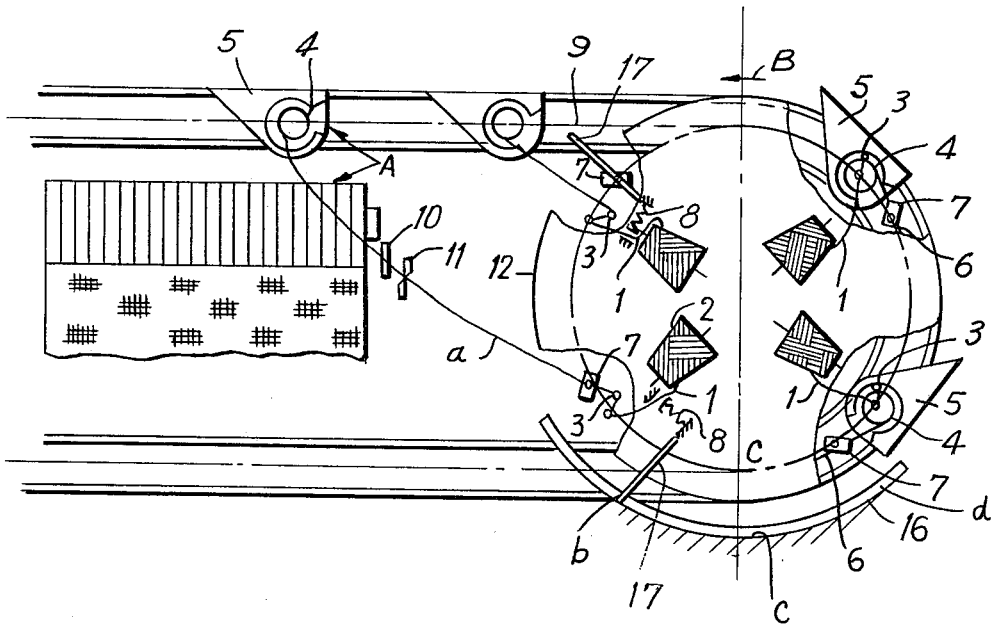
FIG. 6 is a schematic top view of the apparatus illustrated in FIG. 1 further illustrating the cam device comprising an element of one embodiment of the compensation device showing the beginning and end of the interaction of the cam and arm associated therewith.
Figure 2:
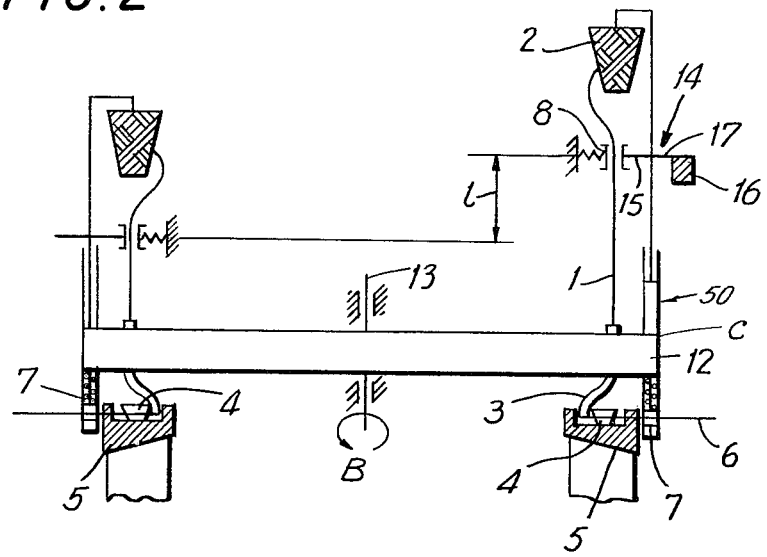
FIG. 2 is a schematic side view of an apparatus of the present invention illustrating one of the embodiments of a device for compensation of the portion of the elongated thread section.

One of the embodiments of the apparatus for practicing the above-described method of the present invention is illustrated in FIGS. 2 and 6 and includes a horizontal disk 12 on which are installed the thread guides 3 and grips 7 for the end 6 of the weft thread 1 formed during initial threading. The guides 3 are installed on the disk 12 so as to be free to rotate around their own axes extending parallel to the axis 13 of rotation of the disk 12. A structure of this type is illustrated in U.S. Pat. No. 3,835,893. The direction of rotation of the disk is conventionally shown in the drawings by an arrow "B". Mounted on the disk 12 are vertically displaceable levers or bell cranks 14. Fixed to one arm 15 of each of the bell cranks are a bobbin 2 and the braking means 8 comprising a spring-loaded tensioner. Fixed rigidly on the loom frame is a profiled cam 16 in contact with a second arm 17 of the bell crank 14.

Referring to FIG. 6, cam 16 has a profile which increases from a lowermost point, designated "b", to an uppermost point, designated "c", and then decreases to a point "d", equal in vertical displacement to point "b". Thus, upon the knife 11 severing a portion of thread section a, the braking means 8 and associated bobbin 2 are located at their lower vertical height through the interaction of arm 17 with cam 16 at point b. As disk 12 continues to rotate in the direction of arrow B, the braking means 8 and associated bobbin are vertically displaced in the upward direction as arm 17 is cammed upwardly on the surface of cam 16, reaching their uppermost location when arm 17 engages cam 16 at point C. This uppermost position is shown at the right in FIG. 2. In FIG. 2, a telescoped tubular structure 50 is schematically illustrated as mounted on disk 12 for vertically guiding the braking means and bobbin and which allows the structure to move downwardly under the force of gravity during engagement of arm 17 on cam 16 from points c and d. Thus, as disk 12 rotates, the bobbin and braking means are first upwardly vertically displaced as arm 17 engages the portion of cam 16 from points b to c and then downwardly displaced as arm 17 engages the portion of cam 16 from points c to d. It is during this upward movement where the braking means 8 travels away from the thread guide 3 to retract the cut portion of the section "a" of weft thread in a direction opposite to the direction of advance thereof during winding of the spool to compensate for the extended length thereof so that this thread is not wasted and instead is subsequently used in winding the thread onto a spool of the shuttle on carrier 5. The winding of the spool is contacted at point C of the travel of disk 12.

Figure 3:
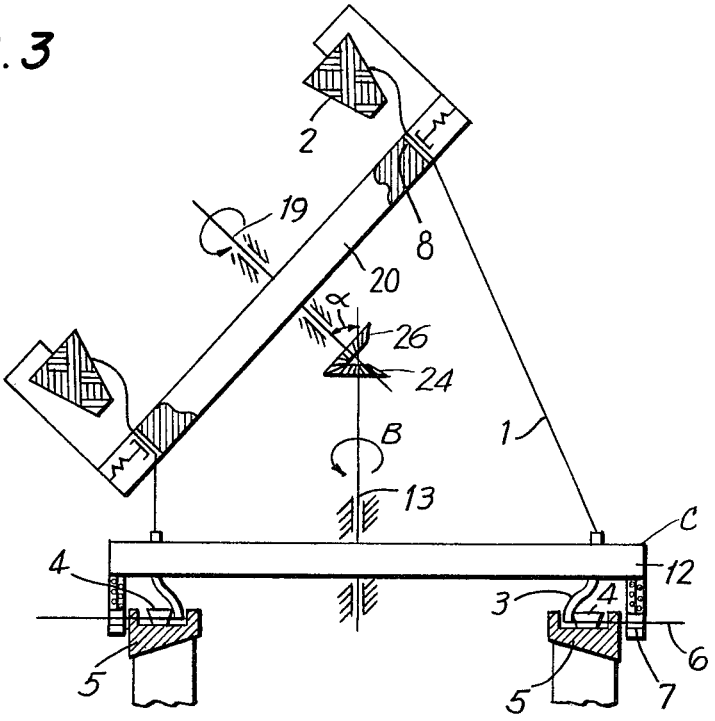
FIG. 3 is a schematic side view of the apparatus according to the present invention, in FIG. 1, illustrating another embodiment of said compensation device.

Referring to FIG. 3, another embodiment of the present invention comprises an additional disk 20 on which are installed the braking means 8 and associated bobbins 2. The additional disk 20 is rotatably mounted above the main disk 12 about an axis of rotation 19 which is disposed at an angle "$\alpha$" to the axis of rotation 19 of the main disk 12. As is shown in FIG. 3, the shaft 13 is driven in the direction of the arrow B by the loom drive in an unillustrated manner, the disk 12 being rotated in the manner apparent from U.S. Pat. No. 3,835,893. The shaft 19 is supported for rotation by schematically illustrated bearings and the shafts 13 and 19 respectively fixedly carry bevel gears 24 and 26 so that the rotation of the shaft 13 is transmitted to the shaft 19, which thus rotates the additional disk 20 in the direction indicated in FIG. 3. The transmission ratio between the bevel gears 24 and 26 is such that as each bobbin 2 together with the brake means 8 associated therewith reaches the lowermost point on the disk 20, shown at the left in FIG. 3, this particular bobbin and brake means will be situated directly opposite the point C indicated in the Figures. The continued rotation of the disk 20 will thus cause the bobbin and brake means shown at the left in FIG. 3 to move upwardly away from the disk 12, thus retracting the thread a which has just been cut by the cutting means 11 back in a direction opposite to the feed direction, so that this thread which otherwise would be wasted is available for winding onto a spool of a shuttle.

The axis of rotation 19 of the additional disk 20 is upwardly inclined in a direction diametrically opposite to the position of the thread guide 3 at the moment the winding of the weft thread 1 onto the spool of the carrier 5 is initiated. This position is indicated in the Figures by point "c". In this case, the distance between the braking means 8 and the thread guide 3 at the point "c" is greater than in the diametrically opposite point by a value equal to the length of the pulled portion of the section "a".

Figure 4:
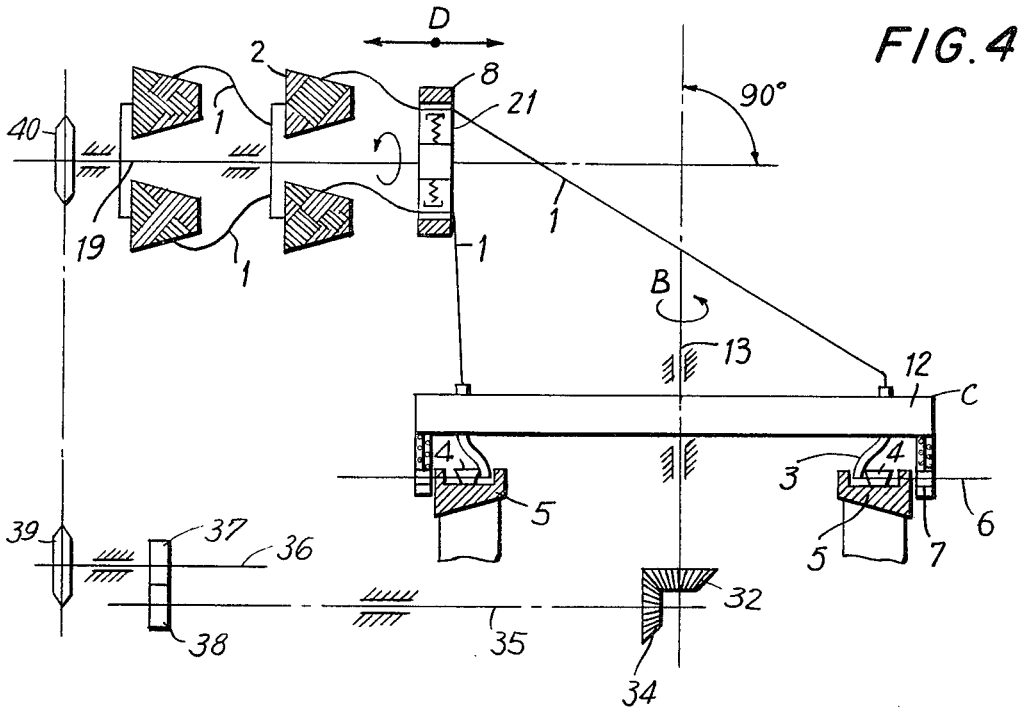
FIG. 4 is a schematic side view of the apparatus according to the present invention in FIG. 1, illustrating still another embodiment of said compensation device.

Referring to FIG. 4 another embodiment of the present invention is illustrated. This embodiment includes an additional disk 21, the axis of rotation 19 of which forms an angle of substantially 90° with the axis of rotation 13 of disk 12. The disk 21 is adapted to rotate about the axis of shaft 19 in conjunction with the rotation of disk 12. More particularly, the shaft 13 defining the axis of rotation of disk 12 has a bevel gear 32 fixed thereto which meshes with a bevel gear 34 fixed on a rotatable horizontal shaft 35. A stub shaft 36 is rotated through the meshing of gears 37, 38 fixed to shafts 36, 35, respectively. A pair of vertically aligned pulleys 39, 40 are respectively fixed to shafts 36, 19 so that rotation of shaft 13 and disk 12 will cause a similar and coordinated rotation of shaft 19 and disk 21. The disk 21 is also displaceable in the horizontal direction axially with respect to shaft 19 in the direction designated D in FIG. 4 in order to selectively adjust the distance between braking means 8 and a respective thread guide 3 as determined by the particular length of thread portion a. Thus, the axial location of disk 21 is preliminarily adjusted and then fixed with respect to shaft 19.

Figure 5:
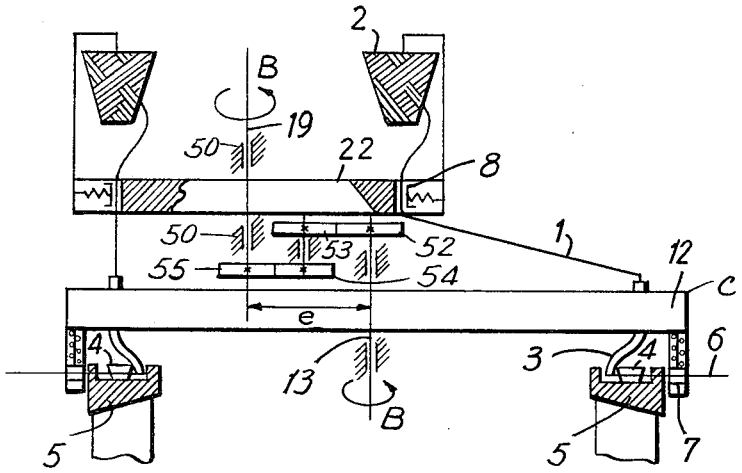
FIG. 5 is a schematic side view of the apparatus according to the present invention illustrating yet another embodiment of said compensation device.

According to yet another embodiment illustrated in FIG. 5, the apparatus for practicing the proposed method is provided with the additional disk 22 rotatably mounted about a shaft or axis of rotation 19 extending parallel to the axis of rotation or shaft 13 of the main disk 12. The axis of rotation 19 is likewise displaced by a distance "e" with respect to the axis of rotation 13 of the main disk 12 in a direction diametrically opposite to the point "c". Moreover, the diameters of the disks 22, 12 differ from each other. The amounts of the displacement of the disks 12 and 22 and the difference between the diameters are chosen according to the required length of the pulled portion of the section "a" for which compensation is provided.

The shaft 13 of FIG. 5 is driven from the loom drive with respect to the rotating disk 12 which of course is driven in a manner shown, for example, in U.S. Pat. No. 3,835,893.

A gear train is provided which comprises a gear 52 fixed to shaft 13, a gear 53 fixed to a stub shaft 54 which meshes with gear 52, a gear 54 fixed to the same stub shaft, and a gear 55 fixed to shaft 19, rotatably synchronizes disk 22 with disk 12. The transmission ratio between the disks 12 and 19 provided by way of the gears 52, 55 is such that as each bobbin 2 and brake means 8 cooperating therewith reaches the location directly opposite the point c, the thread a is cut by the separating means 11 and then during the continued turning of the disk 18c together with the disk 12, the free portion of the thread a extending outwardly beyond the grip 7 is retracted back through the grip 7 so as to be available for winding on a spool of a shuttle as described above.

It is to be noted that with all embodiments the force of friction provided by way of the brake means 8 is greater than that provided by way of the grips 7 so that the thread held by the brake means 8 will be pulled through the grips 7. On the other hand, the tension in the threads resulting from winding thereof onto the spools 4 of the shuttles will be sufficient to overcome the force of the brake means 8, so that the thread will be pulled from the bobbins 2 in order to be supplied to the shuttles.

It is thus apparent that according to the method of the invention thread is wound onto the spools of the shuttles at the winding means formed by the disk 12 and the parts which cooperate therewith, with the shuttles which have been supplied with thread being transported to the weaving zone by way of the conveyor 9, and simultaneously with this transporting of each shuttle to the weaving zone part of the thread wound onto the spool of the shuttle extends from the weaving zone back toward the winding means to form in this way the elongated thread portion a. This elongated thread portion is cut at the region of the weaving zone, by way of the separating means 11, so as to leave a free elongated thread portion extending from the winding means, and in accordance with the invention this free elongated thread portion is retracted back to the winding means.

The structure of the invention thus includes the winding means for winding thread onto the spools of the shuttles, this winding means being formed by the disk 12 and the parts associated therewith, as well as a transporting means 9 for transporting each shuttle which has been supplied with thread from the winding means to the weaving zone while forming a length of thread a extending from the winding means to the weaving zone. The separating means 11 serves to cut the thread a at the region of the weaving zone so as to leave an elongated free portion of the thread a extending from the winding means, and in accordance with the invention a retracting means retracts this free portion of the thread back to the winding means.

In the embodiment of FIGS. 2 and 6, the retracting means is formed by the cam 16 together with the arm 17 of the lever means 14. In the embodiment of FIGS. 3–5, the retracting means is formed by the additional disk 20, 21 and 22 of FIGS. 3–5, respectively, together with the structure cooperating therewith as described above.

Obviously, numerous modifications and variations of the present invention are possible in the light of the above teachings. It is therefore to be understood that within the scope of the appended claims the invention may be practiced otherwise than as specifically described herein.

What is claimed is:

1. A method of threading weft thread onto spools of shuttles in looms with a weaving zone remote from a device for winding the weft thread onto the spools of the shuttles including the steps of: winding the thread onto shuttle spools by winding means, transporting the shuttles along a closed path from the winding means to the weaving zone with simultaneous formation of a straight portion of the thread defined between the shuttle as it reaches the weaving zone and the winding means which effected the winding of the weft thread on the spool of this shuttle; cutting the straight portion of the thread at the edge of the weaving zone so that the free end of the straight portion of the weft thread extends beyond the winding means; arranging the free end of the straight section of the weft thread on the straight line defined between the winding means and a means for braking the weft thread located between the winding means and a bobbin from which the thread is pulled; and removing said free end back to the winding means for winding the free end on the shuttle spool.

2. In a loom, an apparatus for winding a weft thread onto shuttle spools, said apparatus being remote from the weaving zone, comprising: a horizontally disposed rotatable main disk carrying bobbins for weft thread; controlled grips for the end of the weft thread for holding said thread during winding onto said spools; means for controlling the grips mounted on a frame; winding means mounted on said main disk for rotation about their axes from the drives for winding the weft thread onto shuttle spools; means for conveying each shuttle to the weaving zone while forming a straight section of the weft thread extending between the shuttle at the weaving zone, and said winding means for effecting the winding and movement of the shuttles along a closed path; means arranged at the edge of the weaving zone for cutting the straight section of the weft thread to form a free end of the straight weft thread section extending from the grip; lever means mounted on the main disk carrying said bobbins; means for braking the threads when they are uncoiled from each of said bobbins mounted on said lever means; a stationary cam mounted on the loom frame for moving said lever means during winding; said cam adapted to interact with said lever means thus displacing the bobbins and braking means in the direction of removing the end of the straight section of the weft thread back to the winding means.

3. In a loom, an apparatus for winding of a weft thread onto shuttle spools, said apparatus being remote from the weaving zone, comprising: a horizontally disposed rotatable main disk; an additional disk rotating synchronously with said main disk and coupled thereto through transmission gear means; weft thread carrying bobbins mounted on said additional disk; controlled grips for the end of the weft thread for holding said thread during winding onto said spools; means for effecting a braking section with said grips mounted for rotation about their axes from the drives for winding the weft thread onto the shuttle spools; means for conveying each shuttle to the weaving zone while forming a straight section of the weft thread extending the shuttle at the weaving zone and said winding means for effecting the winding and movement of the shuttles along a closed path; means arranged at the edge of the weaving zone for cutting the straight section of the weft thread to form a free end of the straight weft thread section extending from the weft thread end grip; and means for braking the weft thread mounted on said additional disk.

4. A combination according to claim 3, wherein the axis of rotation of said additional disk is inclined at an acute angle with respect to the axis of rotation of said main disk in a direction diametrically opposite to the position of the winding means at the moment that the winding of the weft thread onto the shuttle spool is initiated.

5. A combination according to claim 3, in which the axis of rotation of said additional disk is substantially perpendicular to the axis of rotation of said main disk.

6. A combination according to claim 3, in which the diameter of said additional disk is less than the diameter of said main disk, while its axis of rotation is parallel and displaced from the axis of rotation of said main disk in the direction diametrically opposite to the position of the winding means at the moment that the winding of the weft thread onto the shuttle spool is initiated.

* * * * *